United States Patent [19]

Rocchelli

[11] Patent Number: 4,625,896

[45] Date of Patent: Dec. 2, 1986

[54] DEVICE FOR DISPENSING LIQUID SOAP

[76] Inventor: Gianpaolo Rocchelli, Via Leonardo da Vinci 38, Brescia, Italy

[21] Appl. No.: 699,371

[22] Filed: Feb. 7, 1985

[30] Foreign Application Priority Data

Feb. 17, 1984 [IT] Italy ..... 6925/84[U]

[51] Int. Cl.[4] ..... B67D 5/40

[52] U.S. Cl. ..... 222/180; 222/192; 222/372

[58] Field of Search ..... 248/56; 285/8, 61, 64; 222/173–174, 129, 180, 192, 320, 330–331, 372, 405, 464, 478, 482; 239/304–305, 312, 442–444, 448

[56] References Cited

U.S. PATENT DOCUMENTS

| | | | |
|---|---|---|---|
| 519,513 | 5/1894 | Torchiani | 222/482 X |
| 2,434,846 | 1/1948 | Hagan | 285/8 |
| 2,686,694 | 8/1954 | Freeman | 239/444 X |
| 2,767,019 | 10/1956 | Manville | 239/444 X |
| 3,134,545 | 5/1964 | Armond | 222/482 X |
| 3,713,585 | 1/1973 | Conklin | 239/305 X |

*Primary Examiner*—Joseph J. Rolla
*Assistant Examiner*—Michael S. Huppert
*Attorney, Agent, or Firm*—Guido Modiano; Albert Josif

[57] ABSTRACT

The device is affixable to a unit such as a mixer tap or a tap outlet which delivers water to wash basins or sinks, and comprises at least one delivery outlet for liquid soap. The outlet has affixed thereto, or integrally formed therewith a substantially part-annular collar which is insertable between the base of the body of the unit which delivers water and the plane on or against which the unit is fixed. The collar is secured in such location by a threaded connection utilized for fixing the unit to the plane.

9 Claims, 5 Drawing Figures

DEVICE FOR DISPENSING LIQUID SOAP

BACKGROUND OF THE INVENTION

The present invention relates to a device for dispensing liquid soap which can be fitted to, and is usable with, a water delivery unit such as a mixer tap.

Liquid soap dispensers are known. Generally, such dispensers comprise a container or reservoir for the soap and a pump device which includes a conduit which dips into the contents of the reservoir. However, it is believed that most such dispensers are independent units which are fixed to a wall or to the sanitary fitting such as a washbasin. In the latter case, the unit is constructed with means for receiving the dispenser.

SUMMARY OF THE INVENTION

The present invention seeks to provide a device for dispensing liquid soap which can be readily fitted to units which deliver water such as mixer taps, conventional taps and water outlets in wash basins or sinks without the necessity of modifying the unit, modifying their method of installation, or modifying the structure of fittings in which water and liquid soap are provided separately and independently. At the same time, the invention seeks to provide a device which permits the units for the delivery of water to be provided with a soapholder without interfering with, or restricting the use of, the units or assemblies in providing a water supply without liquid soap.

According to the present invention there is provided a device for dispensing liquid soap affixable to a unit such as a mixer tap or a tap outlet which delivers water to wash basins or sinks comprising at least one delivery outlet for the liquid soap, the outlet having affixed thereto, or integrally formed therewith, a substantially part-annular collar which is insertable between the base of the body of the unit which delivers the water and the plane on or against which the unit, which delivers the water, is fixed, the collar being secured in such location by the means utilised for fixing the delivery unit to the plane.

Also according to the present invention, there is provided a device for the delivery of liquid soap applicable to units which deliver water to wash basins or sinks comprising at least one outlet for the delivery of liquid soap affixed to or integral with a bush or ring which is secured between the base of the body of the unit which delivers the water and the plane on or against which the unit, which delivers water, is fixed, the bush or ring being secured in position by the means utilised for fixing the unit to the plane.

BRIEF DESCRIPTION OF THE DRAWINGS

Two embodiments of the present invention will be further described, by way of example, with reference to the accompanying drawings, in which.

DESCRIPTION OF THE PREFERRED EMBODIMENTS

Figure 1:
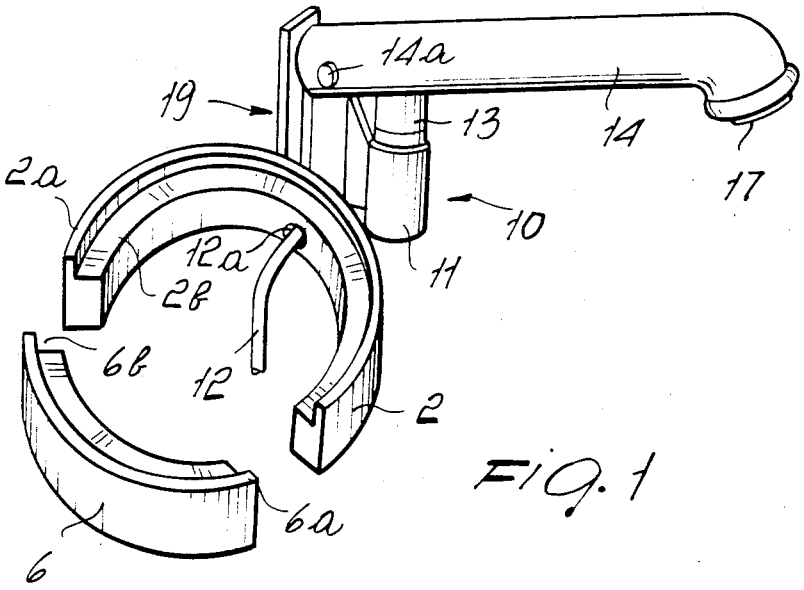
FIG. 1 shows a perspective view of a liquid soap dispensing device in accordance with the present invention.
Figure 4:
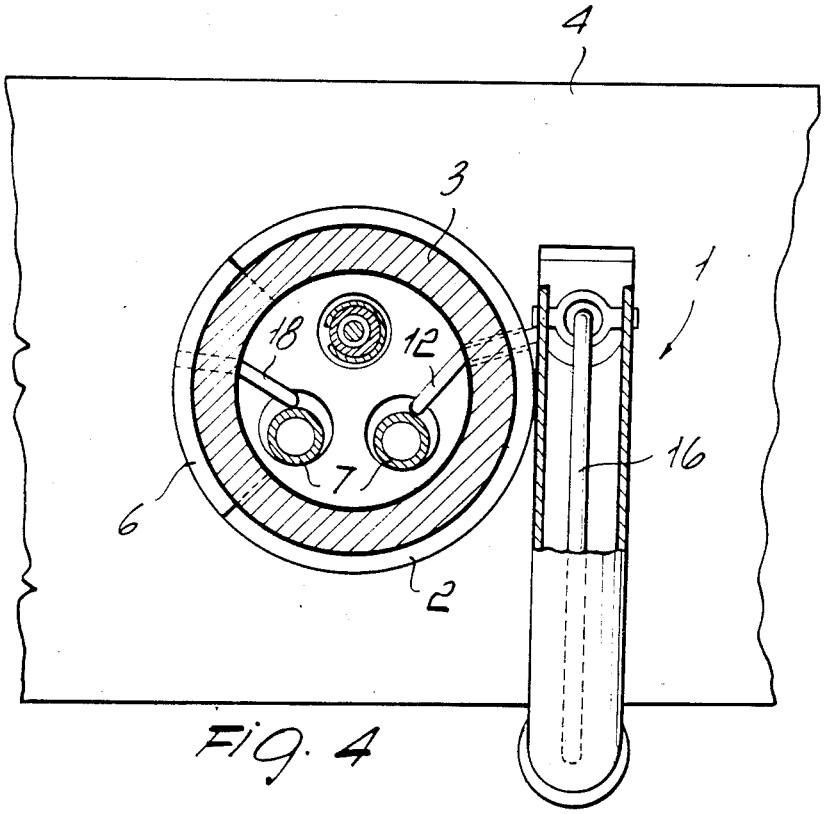
FIG. 4 is a transverse section taken along the line IV—IV in FIG. 3.
Figure 3:
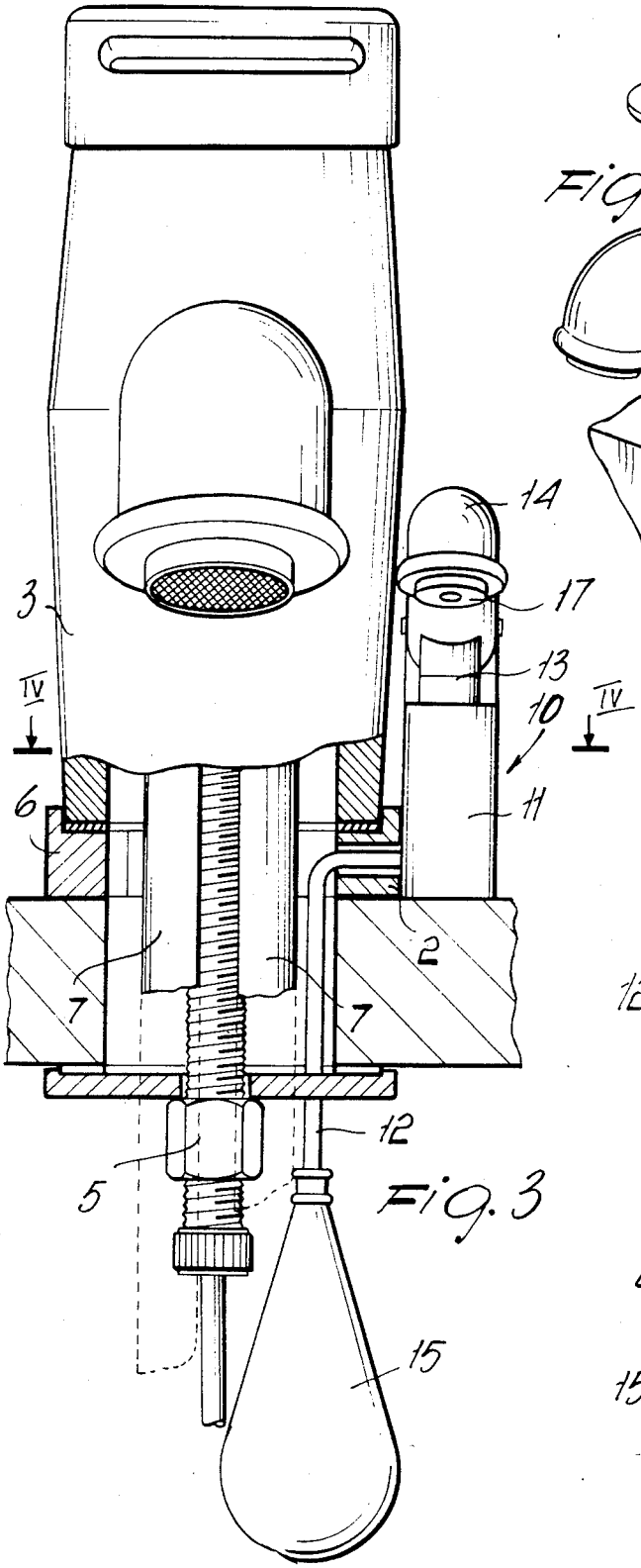
FIG. 3 is an elevational view, partially in section, of the tap and dispensing device shown in FIG. 2 and also shows the mounting assembly.
Figure 2:
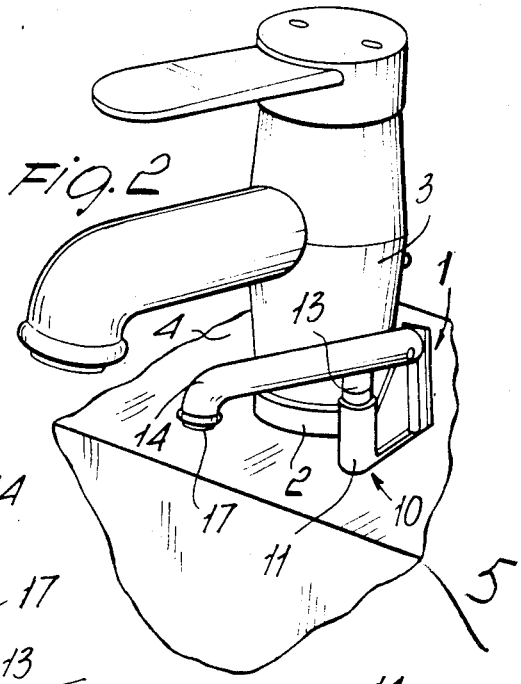
FIG. 2 shows the device of FIG. 1 connected to a mixer tap.

In the drawings, there is shown a liquid soap dispensing device which is generally referenced 1. The device may be of any suitable configuration and structure. In accordance with the present invention, the device 1 is integral with, or has fitted thereto a collar. The collar 2 is C-shaped or otherwise open in one region and, in use, will be fitted between the lower end of the body portion 3 of a mixer tap or any other type of outlet for the delivery of water and the plane 4 of the fitting such as a wash basin or sink to which the mixer tap or outlet is connected by means of a threaded connection 5. The C-shaped collar 2 may have a ring segment 6 associated therewith which supplements the collar to provide a more attractive finish when it is fitted to the mixer tap or outlet.

As visible from the drawings, both the collar 2 and the ring segment 6 present an outer, upwards projecting edge *2a, 6a* so as to define a recess *2a ,6b 2b, 6b* for accommodating therein and centering the base of the body portion 3.

In the embodiment shown in FIGS. 1–4, the device 1 comprises a pump 10 which includes a cylinder 11 in communication with a soap intake tube 12, extending through a hole *12a* into a liquid-soap reservoir 15. The pump 10 also includes a piston 13 which is attached to and displaceable by an operating lever 14, pivoted at *14a* to a support 19.

The soap intake tube 12 communicates, by means of a valve system (not shown), with a soap delivery tube 16. The tube 16 terminates in an outlet 17.

Preferably, but not essentially, the reservoir 15 is located below the level of the plane 4 of the fitting to which the unit for the delivery of water is attached. The delivery tube 16 is located at least partially and, if desired, wholly within the operating lever in such a way that the delivery of the liquid soap corresponds to the movement of the lever 14.

Figure 5:
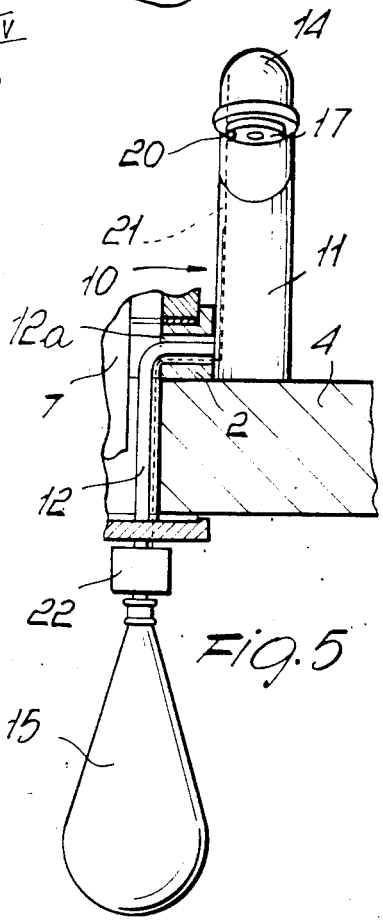
FIG. 5 is an elevation view, partially in section, of a further embodiment of the dispensing device, as applied to an only partially shown mixer tab.

The movement of the lever 14 is usually effected manually although, if desired, the lever or the pump 10 could be controlled by electrical means including a sensor which is activated when the outlet 17 is grasped manually. Such a solution is implemented in the arrangement shown in FIG. 5. In this figure, a sensor 20, attached to the outlet 17 of tube 16 is connected, through an electric cable 21, to a simple electric circuit (not shown) which controls a small compressor 22. Therefore upon detection of a user's hand by the sensor 20, the compressor is cause to drain liquid soap and to deliver it through the tube 16. Compressor 22 and sensor 20 can be powered by a suitable battery or by the network through a transformer. As in the embodiment according to FIG. 5, the pump 10 is no longer necessary, the outlet of the dispensing device can be construed as a unique, rigid body whereto the collar 2 is attached.

The liquid soap dispensing device of the present invention can be easily and rapidly fitted to any unit for the delivery of water, even if such delivery unit is already installed on a wash basin or sink. The device does not necessitate modification of the delivery unit.

In order to fit device 1 in position, it is merely necessary to fit the C-shaped collar 2 and the additional annular segment 6 between the body 3 of the mixer tap or outlet for the delivery of water and then to secure the tap unit fitting in position by means of the threaded connection 5.

The C-shaped collar and the corresponding annular segment 6 may be provided with means for connecting the dispenser to, and for centering it on the body 3 of the mixer tap or outlet to prevent undue movements of either part with respect to the other. In any event the C-shaped collar 2 and the annular segment 6 surround the riser pipe and/or the pipes 7 through which the water passes to the mixer tap or delivery outlet. If the liquid soap container 15 is located below the sanitary fitting, the intake pipe 12 passes radially into the C-shaped collar 2 and extends into the container 15. The portion of the pipe 12 directed towards the container 15 passes through the plane 4 of the fitting and extends parallel to the riser and/or the pipes delivering water 7 to the mixer tap or the delivery outlet.

In such a case, an additional, removable, annular segment may be fitted which exposes the end of an auxiliary pipe 18 so that the container 15 can be refilled from above. The pipe 18 is hidden and closed off when the annular segment is reconnected to the C-shaped collar.

A liquid soap dispenser device 1 can thus be associated with units for the delivery of water without modifying either the traditional method of installation or the use of such units or modifying the fittings such as wash basins and sinks to which they are attached.

It should also be noted that liquid soap dispenser device 1 may be applied to the water delivery outlet by means of a complete ring or bush instead of a C-shaped collar although, in such a case the connection between the two components is made in an axial direction by threading the water pipes and/or the riser of the unit through the ring or bush.

The device 1 is therefore both convenient and practical to use and permits liquid soap to be dispensed directly in the vicinity of the means for the delivery of water without the reservoir therefore being visible. Moreover, the device does not interfere with the normal operation of the unit for the delivery of water.

The pump dispenser may, if desired, also be located within or below the collar or ring so that only the delivery outlet is exposed to view.

I claim:

1. A device for dispensing liquid soap affixable to a water delivery unit such as a mixer tap, a tap outlet and similar tap which delivers water to wash basins or sinks, comprising at least one delivery conduit for liquid soap, said delivery conduit having affixed thereto a substantially part-annular collar which is insertable in a location between a water delivery unit body base and a water delivery unit support plane, the collar being held in said location by water delivery unit fixing means, wherein the device further comprises pumping means communicating with an inlet conduit connected to said delivery conduit and extending radially through said collar, said inlet conduit having a portion extending parallel to water delivery unit riser pipe, one end of said inlet conduit being locatable in a reservoir of liquid soap.

2. A device as claimed in claim 1, wherein the collar has an annular segment associated therewith, the segment completing and closing an annular ring, the collar and the annular segment, in use, surrounding a water delivery unit riser pipe.

3. A device as claimed in claim 2, in which the collar and the annular segment include attachment and centering means for a water delivery unit body.

4. A device as claimed in claim 2, wherein the annular segment is removable and conceals a conduit for refilling a liquid soap reservoir.

5. A device as claimed in claim 1 further comprising an operating lever and valve means, said operating lever including a liquid soap delivery outlet, said delivery conduit being adapted for connecting said inlet conduit to said soap delivery outlet, said valve means being interposed between said inlet conduit and said delivery conduit, said operating lever being functionally connected to and adapted for operating said pumping means.

6. A device as claimed in claim 5 wherein said operating lever has at least one portion, said liquid soap delivery outlet being located substantially at said portion of said operating lever, said delivery conduit extending within said operating lever from said valve means to said liquid soap delivery outlet.

7. A device as claimed in claim 5 wherein said operating lever is adapted for being actuated manually, and wherein said pumping means is in turn adapted to be controlled manually by actuation of said operating lever.

8. A device as claimed in claim 1, comprising sensor means arranged at a delivery outlet of said delivery conduit, said sensor means being electrically connected to and operating said pumping means.

9. A device for dispensing liquid soap affixable to a water delivery unit such as a mixer tap, a tap outlet, and similar tap which deliver water to wash basins or sinks, comprising at least one delivery conduit for liquid soap, said delivery conduit having affixed thereto a bush member, said bush member being adapted to be secured in a location between a water delivery unit body base and a water delivery unit support plane, said bush member being secured in said location by water delivery unit fixing means, wherein the device further comprises pumping means communicating with an inlet conduit connected to said delivery conduit and extending radially through said bush member, said inlet conduit having a portion extending parallel to water delivery unit riser pipe, one end of said inlet conduit being locatable in a reservoir of liquid soap.

* * * * *